US008353357B2

(12) United States Patent
Thompson

(10) Patent No.: US 8,353,357 B2
(45) Date of Patent: Jan. 15, 2013

(54) FIRE PROTECTION SPRINKLER WITH HIGHLY SENSITIVE TRIGGER

(75) Inventor: Andrew T. Thompson, Hastings, MI (US)

(73) Assignee: The Viking Corporation, Hastings, MI (US)

( * ) Notice: Subject to any disclaimer, the term of this patent is extended or adjusted under 35 U.S.C. 154(b) by 266 days.

(21) Appl. No.: 12/471,008

(22) Filed: May 22, 2009

(65) Prior Publication Data

US 2010/0294521 A1 Nov. 25, 2010

(51) Int. Cl.

| | |
|---|---|
| ***A62C 37/08*** | (2006.01) |
| ***A62C 37/36*** | (2006.01) |
| ***A62C 3/06*** | (2006.01) |
| ***A62C 37/12*** | (2006.01) |

(52) U.S. Cl. ..... 169/38; 169/42; 169/56; 169/57

(58) Field of Classification Search ..... 169/38, 169/42, 46, 56, 57

See application file for complete search history.

(56) References Cited

U.S. PATENT DOCUMENTS

| | | | | |
|---|---|---|---|---|
| 1,465,477 | A * | 8/1923 | Lubbock | 169/39 |
| 4,757,865 | A | 7/1988 | Simons | |
| 4,893,679 | A * | 1/1990 | Martin et al. | 169/39 |
| 6,152,236 | A | 11/2000 | Retzloff et al. | |
| 6,840,329 | B2 * | 1/2005 | Kikuchi et al. | 169/37 |
| 7,290,618 | B2 | 11/2007 | Thomas et al. | |
| 7,584,803 | B2 * | 9/2009 | Ballard | 169/40 |
| 2006/0102362 | A1 | 5/2006 | Polan | |
| 2007/0187116 | A1 | 8/2007 | Jackson et al. | |

* cited by examiner

*Primary Examiner* — Len Tran
*Assistant Examiner* — Ryan Reis
(74) *Attorney, Agent, or Firm* — Harness, Dickey & Pierce, P.L.C.

(57) ABSTRACT

A heat responsive trigger assembly for a fire protection sprinkler may include a first plate having a bottom face; a second plate including a top face engaging the bottom face; a thermally conductive member disposed between the top and bottom faces and extending beyond a perimeter of at least one of the first and second plates; and a heat fusible material securing the first and second plates in an engaged position. The first and second plates may disengage in response to the heat fusible material reaching a predetermined temperature, thereby allowing a fire suppressant to discharge from the sprinkler.

57 Claims, 15 Drawing Sheets

FIRE PROTECTION SPRINKLER WITH HIGHLY SENSITIVE TRIGGER

FIELD

The present disclosure relates to a fire protection sprinkler, and more particularly to a fire protection sprinkler having a highly sensitive trigger.

BACKGROUND

This section provides background information related to the present disclosure which is not necessarily prior art.

Fire protection sprinklers are commonly mounted on or near ceilings or walls of a building. Such sprinklers may disperse water, foam, or other fire suppressant material to suppress or extinguish a fire. The sprinklers may include a heat sensitive trigger mechanism operable in an engaged position to prevent the flow of the fire suppressant. In response to heat, solder or other fusible material may melt, disengaging the trigger mechanism to release a plug device and allow the sprinkler to discharge the fire suppressant into the room below.

Early response to the outbreak of a fire often minimizes or reduces personal injury and/or property damage as a result of the fire. The response time of the trigger assembly, or the time required to melt the solder and release the plug device, is often critical to the ability of the sprinkler to mitigate or prevent personal injury and/or property damage.

SUMMARY

This section provides a general summary of the disclosure, and is not a comprehensive disclosure of its full scope or all of its features.

In one form, the present disclosure provides a heat responsive trigger assembly for a fire protection sprinkler. The trigger assembly may include a first plate having a bottom face; a second plate including a top face engaging the bottom face; a thermally conductive member disposed between the top and bottom faces and extending beyond a perimeter of at least one of the first and second plates; and a heat fusible material securing the first and second plates in an engaged position. The first and second plates may disengage in response to the heat fusible material reaching a predetermined temperature, thereby allowing a fire suppressant to discharge from the sprinkler.

In another form, the present disclosure provides a sprinkler assembly which may include a sprinkler body adapted to engage a supply line, the sprinkler body including an orifice providing a passageway therethrough; a plurality of frame arms extending from the sprinkler body and including a deflector disposed thereon adapted to alter a trajectory of a fire suppressant; a plug adapted to seal the orifice in an engaged position; and a trigger assembly adapted to releasably secure the plug in an engaged position, the trigger assembly including a first lever engaging a first plate, a second lever engaging a second plate, and a conductor member disposed between the first and second plates. A heat fusible material may releasably secure a top surface of the first plate to a bottom surface of the second plate and the conductor member therebetween, whereby at least a portion of the conductor member extends beyond perimeters of the first and second plates thereby facilitating heat conduction to the heat fusible material.

In yet another form, the present disclosure provides a sprinkler assembly which may include a sprinkler body adapted to engage a supply line, the sprinkler body including an orifice providing a passageway therethrough; a plurality of frame arms extending from the sprinkler body and including a deflector disposed thereon adapted to alter a trajectory of a fire suppressant; a plug adapted to seal the orifice in an engaged position; and a trigger assembly adapted to releasably secure the plug in said engaged position. The trigger assembly may include a first plate having a top surface, a second plate having bottom surface contacting the top surface of the first plate, a conductor member disposed between the first and second plates, a first pin engaging at least one of the first and second plates and engaging the plug at a first end, and a second pin having a first member and a second member, the first member engaging a second end of the first pin, the second member engaging at least one of the first and second plates. A heat fusible material may releasably secure the first plate to the second plate, and the conductor member is adapted to facilitate conduction of heat to said heat fusible material.

In still another form, the present disclosure provides a sprinkler assembly which may include a sprinkler body adapted to engage a supply line, the sprinkler body including an orifice providing a passageway therethrough; a deflector including a seal member adapted to seal the orifice, the deflector is disposed on a plurality of elongated members slidably engaging a plurality of apertures in the sprinkler body and movable between a concealed position and a deployed position; and a trigger assembly adapted to releasably secure the deflector in the concealed position. The trigger assembly may include a first plate having a first aperture and a top surface; a second plate having a second aperture and a bottom surface contacting the top surface of the first plate; a conductor member disposed between the top and bottom surfaces; a first pin engaging the first aperture and the sprinkler body; and a second pin engaging the second aperture and the sprinkler body. A heat fusible material may releasably secure the first plate to the second plate, and the conductor member is adapted to facilitate conduction of heat to the heat fusible material.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
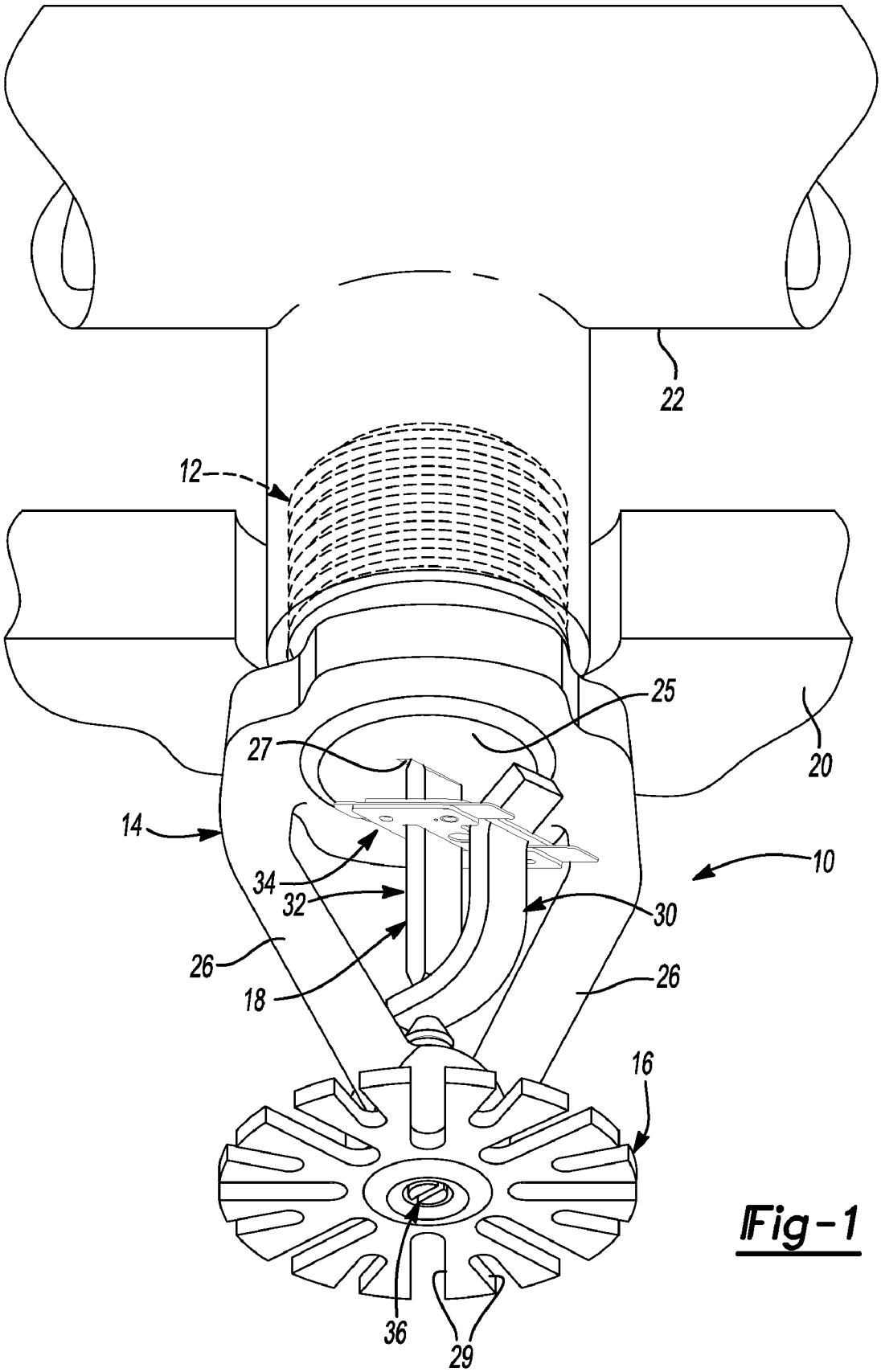
FIG. 1 is a perspective view of a sprinkler assembly having a trigger assembly according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
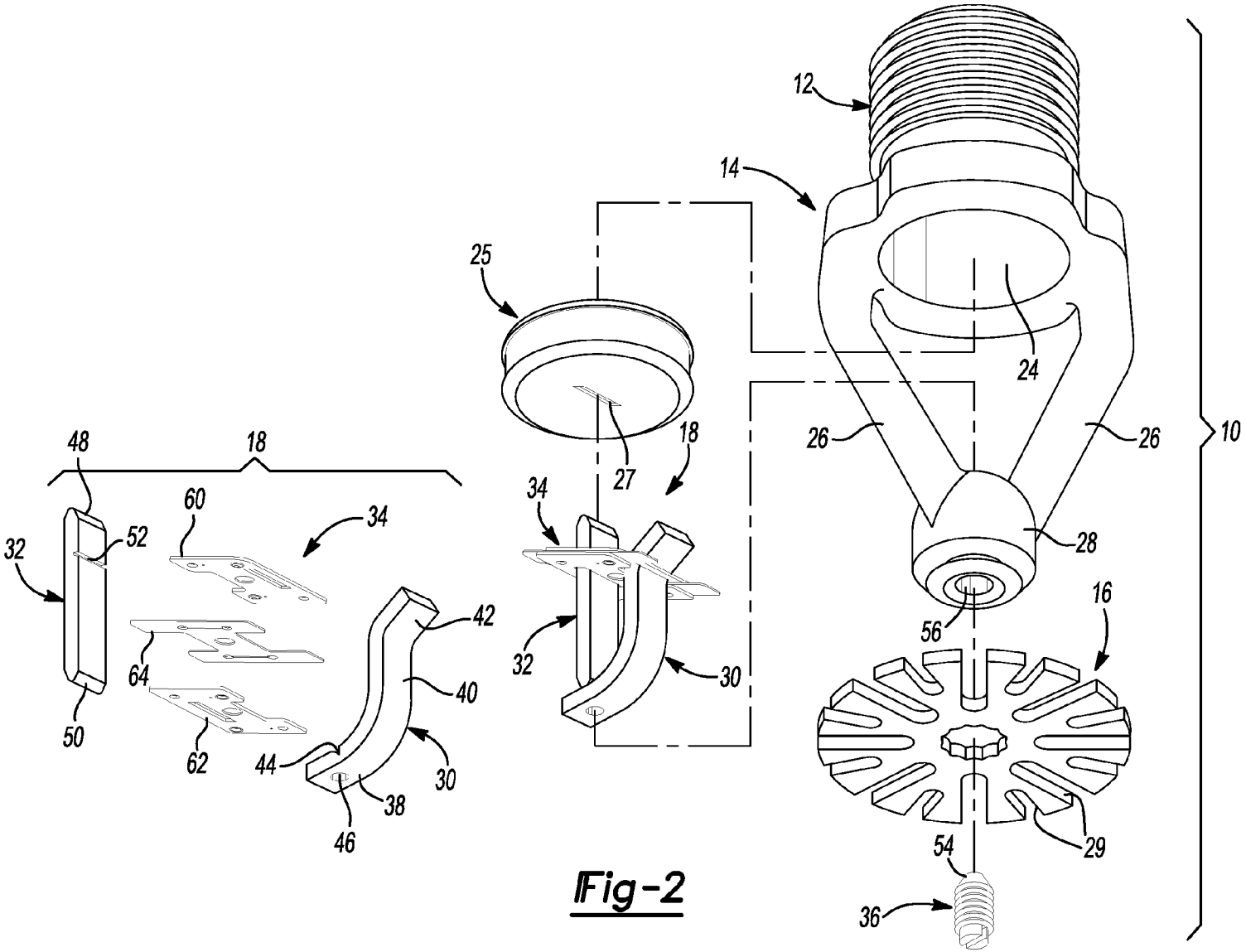
FIG. 2 is an exploded perspective view of the sprinkler assembly of FIG. 1.

With reference to FIGS. 1 and 2, a fire protection sprinkler assembly is provided and is generally referred to as the sprinkler assembly 10. The sprinkler assembly 10 may include a sprinkler body 12, a frame 14, a deflector 16, and a trigger assembly 18. The sprinkler assembly 10 may be installed in or near a ceiling 20 or sidewall of a building, for example, and may be operable to discharge a fire suppressing material in response to exposure to a predetermined level of heat, as will be subsequently described. It will be appreciated that the sprinkler assembly 10 could be installed in any type of building or structure and in any desirable location within the building or structure.

The sprinkler body 12 may be a generally cylindrical member and may threadably or otherwise engage a supply line 22. The sprinkler body 12 may include a central orifice 24 in communication with the supply line 22. The supply line 22 may be a water pipe, for example, adapted to supply water to the sprinkler assembly 10. It will be appreciated that the supply line 22 could supply any fire suppressant or fire extinguishing fluid or substance such as, for example, water, a fire suppressing foam, powder, liquid, gas, or any other substance operable to suppress, extinguish or reduce the propagation of a fire. Accordingly, the term "fire suppressant," as used herein, is meant to include any such fluid or substance.

A seal or plug 25 may be a generally cylindrical member pressed into the orifice 24 of the sprinkler body 12. The plug 25 may seal the orifice 24 to prevent the fire suppressant from flowing therethrough until the trigger assembly 18 is actuated. The plug 25 may include an outward facing surface having a slot 27, as shown in FIG. 2.

The frame 14 may include one or more frame arms 26 and an apex 28. The frame arms 26 may extend from the sprinkler body 12 and may support the deflector 16 at a predetermined distance apart from the orifice 24. The frame arms 26 may be substantially rigid members providing structural support for the deflector 16 and clearance for the trigger assembly 18 between the orifice 24 and the deflector 16.

The deflector 16 may be a generally circular disk having a plurality of slots, apertures and/or cutouts 29. The deflector 16 may be formed to manipulate the flow or alter a trajectory of the fire suppressant through the sprinkler assembly 10 to achieve a desired spray pattern, as is known in the art. Accordingly, the deflector 16 can have any suitable shape, size, or pattern of slots, apertures and/or cutouts to achieve a desired fire suppressant flow pattern.

It will be appreciated that the sprinkler body 12, frame 14 and deflector 16 may be formed from a metallic material or any other material or combination of materials suited to provide structural integrity and heat resistance. The sprinkler body 12, the frame 14 and the deflector 16 can be integrally formed, welded or threadably fastened to each other, for example, or otherwise suitably joined.

Referring now to FIGS. 1-12, the trigger assembly 18 may include a first member or pin 30, a second member or pin 32, a fusible link 34, and an adjustment member 36. The trigger assembly 18 may be actuated to release the plug 25 from the orifice 24 and allow the fire suppressant to flow through the orifice 24 in response to exposure to a predetermined level of heat from a fire or other heat source, as will be subsequently described.

The first pin 30 may be generally S-shaped and may include a top portion 38, a middle portion 40, and a bottom portion 42. The top portion 38 may include a generally V-shaped notch 44 and a dimple 46. The top portion 38 may extend from the middle portion 40 in a first direction, and the bottom portion 42 may extend from the middle portion 40 in a second direction.

The second pin 32 may be a generally linear member having a tapered first end 48, a tapered second end 50, and a slot 52. The first end 48 may be engaged with the slot 27 in the outwardly facing surface of the plug 25. The second end 50 may be engaged with the notch 44 of the first pin 30.

The adjustment member 36 may be a threaded member having a generally conical tip 54. The adjustment member 36 may threadably engage a threaded aperture 56 in the apex 28 of the frame 14. The adjustment member 36 can be threadably positioned such that the conical tip 54 engages the dimple 46 in the top portion 38 of the first pin 30, as shown in FIG. 1.

Figure 7:
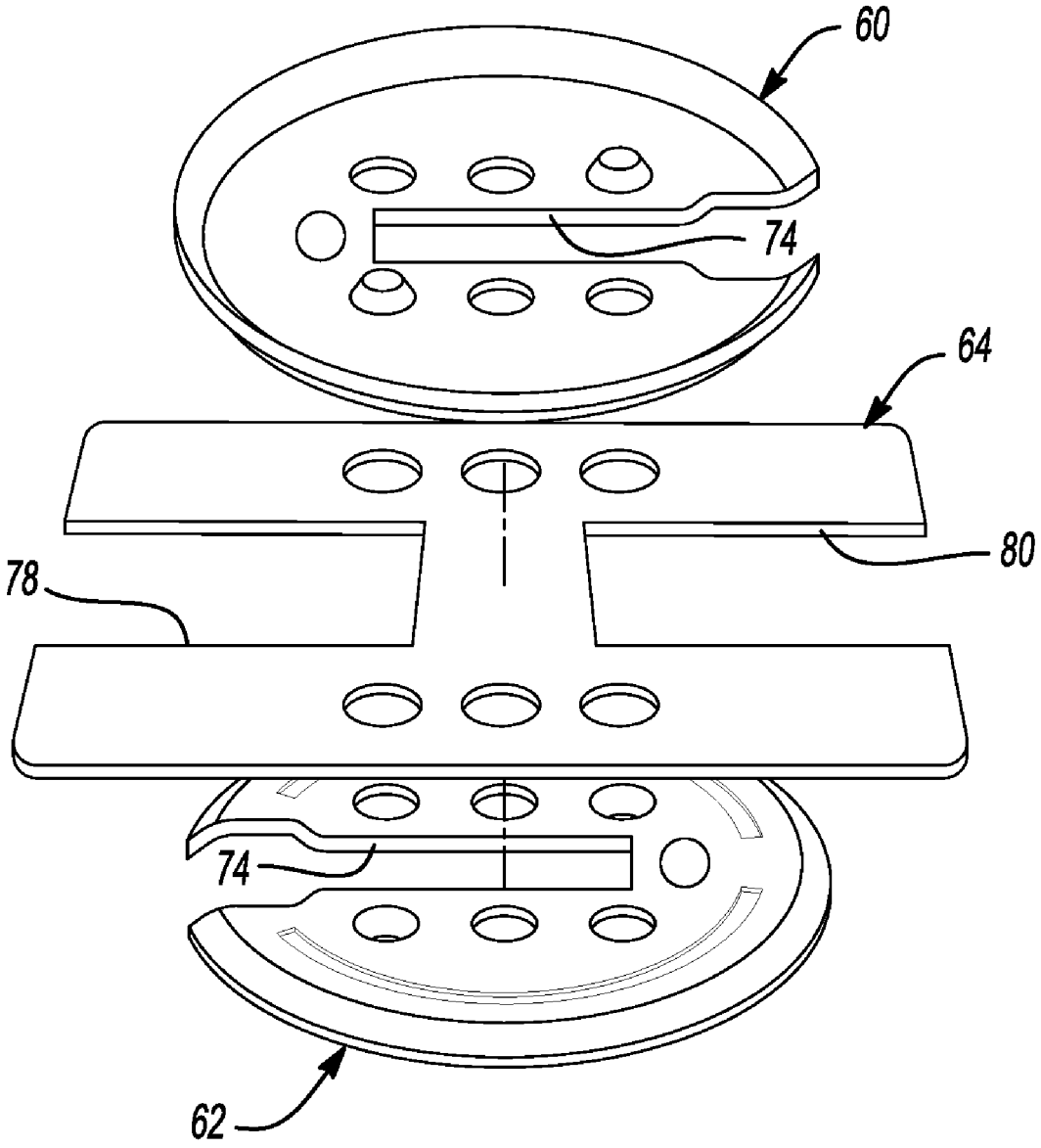
FIG. 7 is an exploded perspective view of yet another embodiment of a fusible link according to the principles of the present disclosure.
Figure 8:
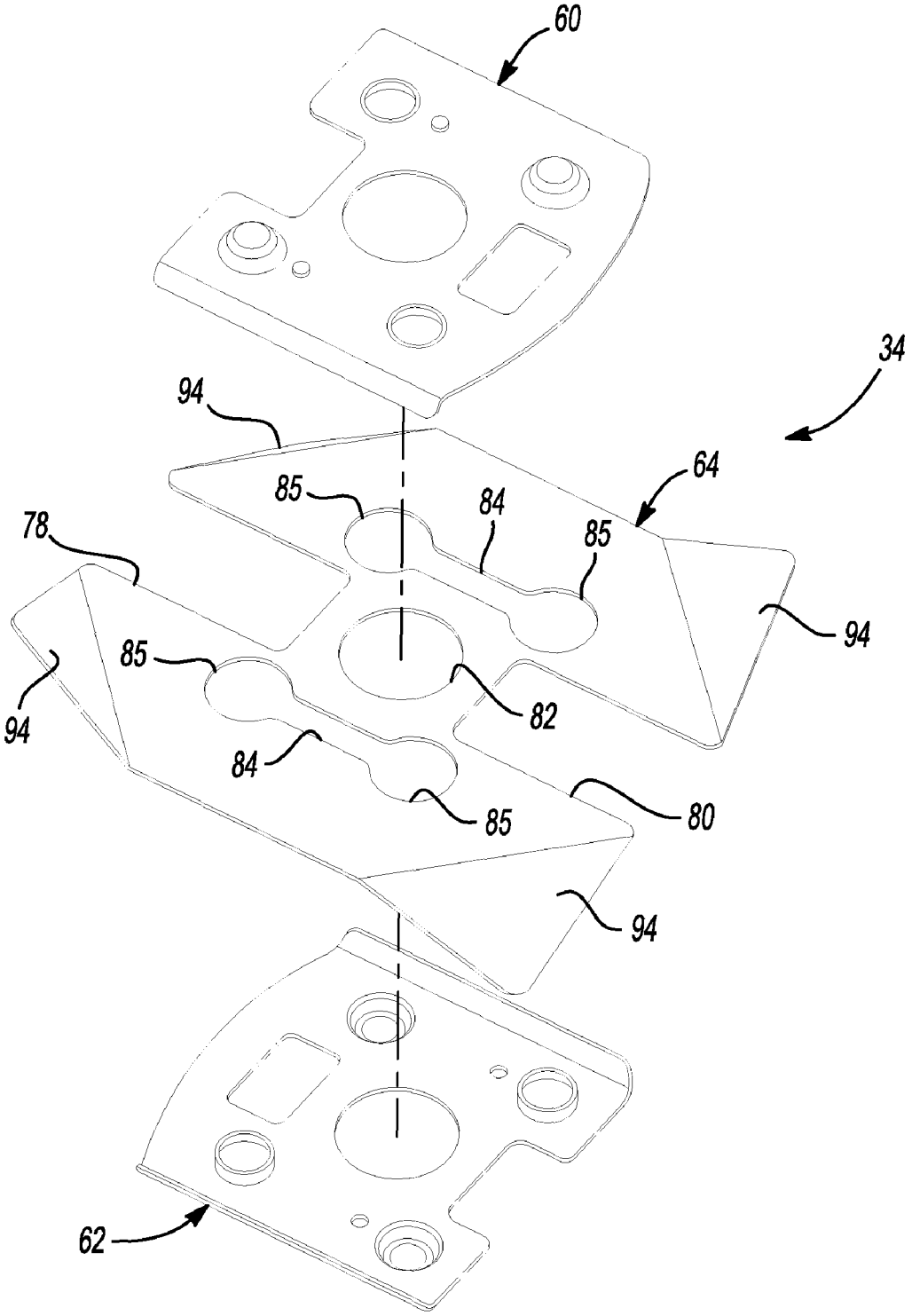
FIG. 8 is an exploded perspective view of still another embodiment of a fusible link according to the principles of the present disclosure.
Figure 9:
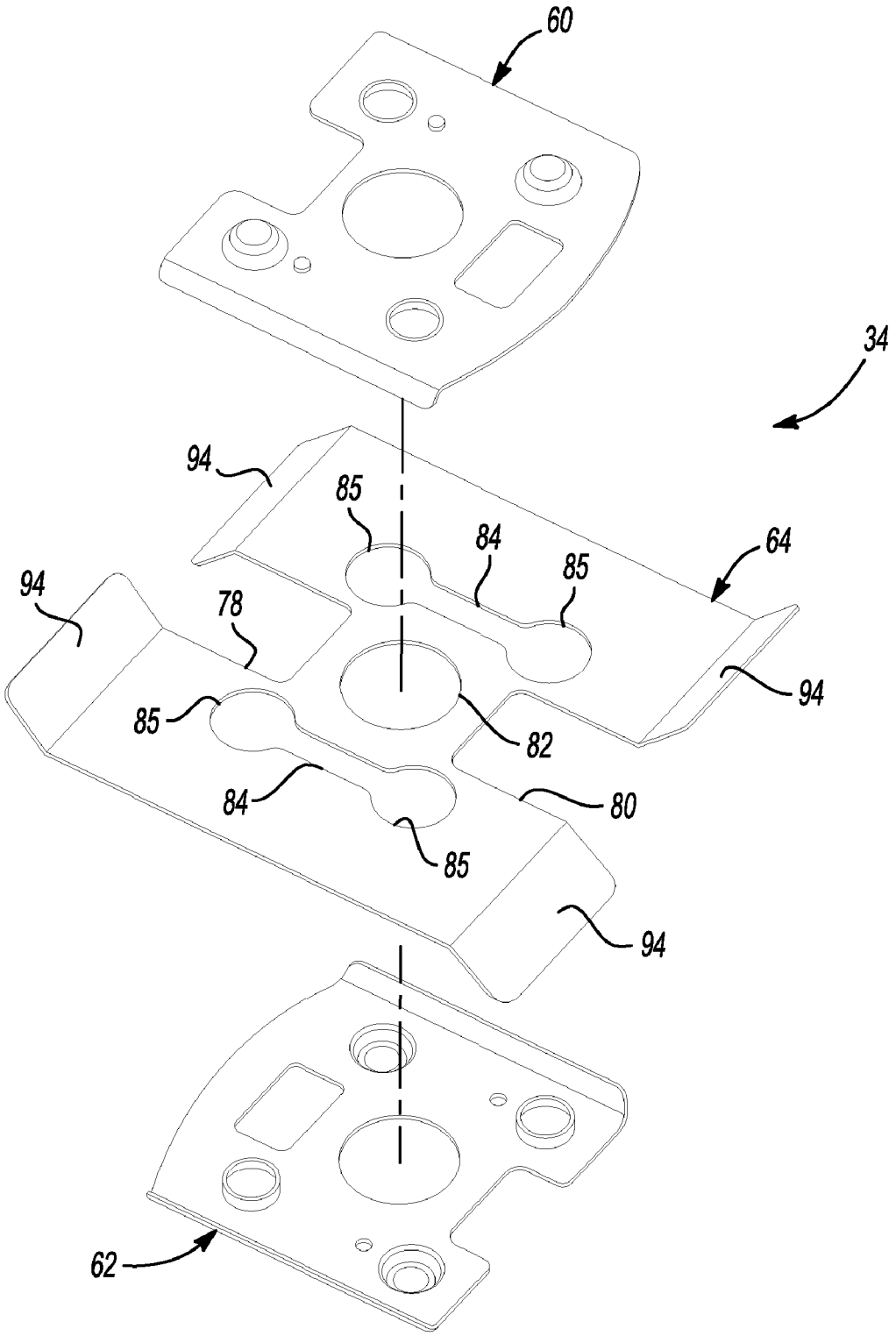
FIG. 9 is an exploded perspective view of still another embodiment of a fusible link according to the principles of the present disclosure.
Figure 10:
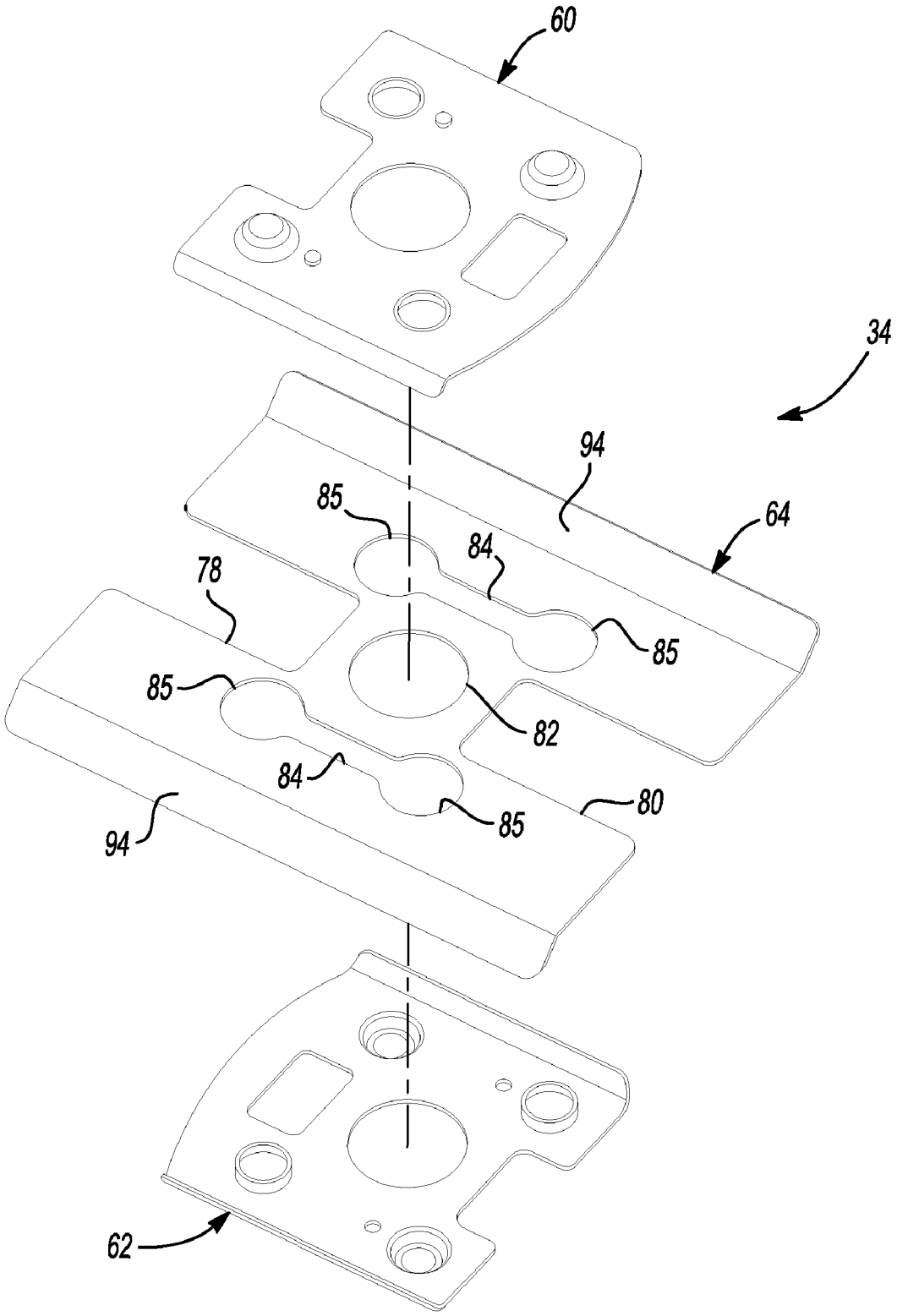
FIG. 10 is an exploded perspective view of still another embodiment of a fusible link according to the principles of the present disclosure.
Figure 11:
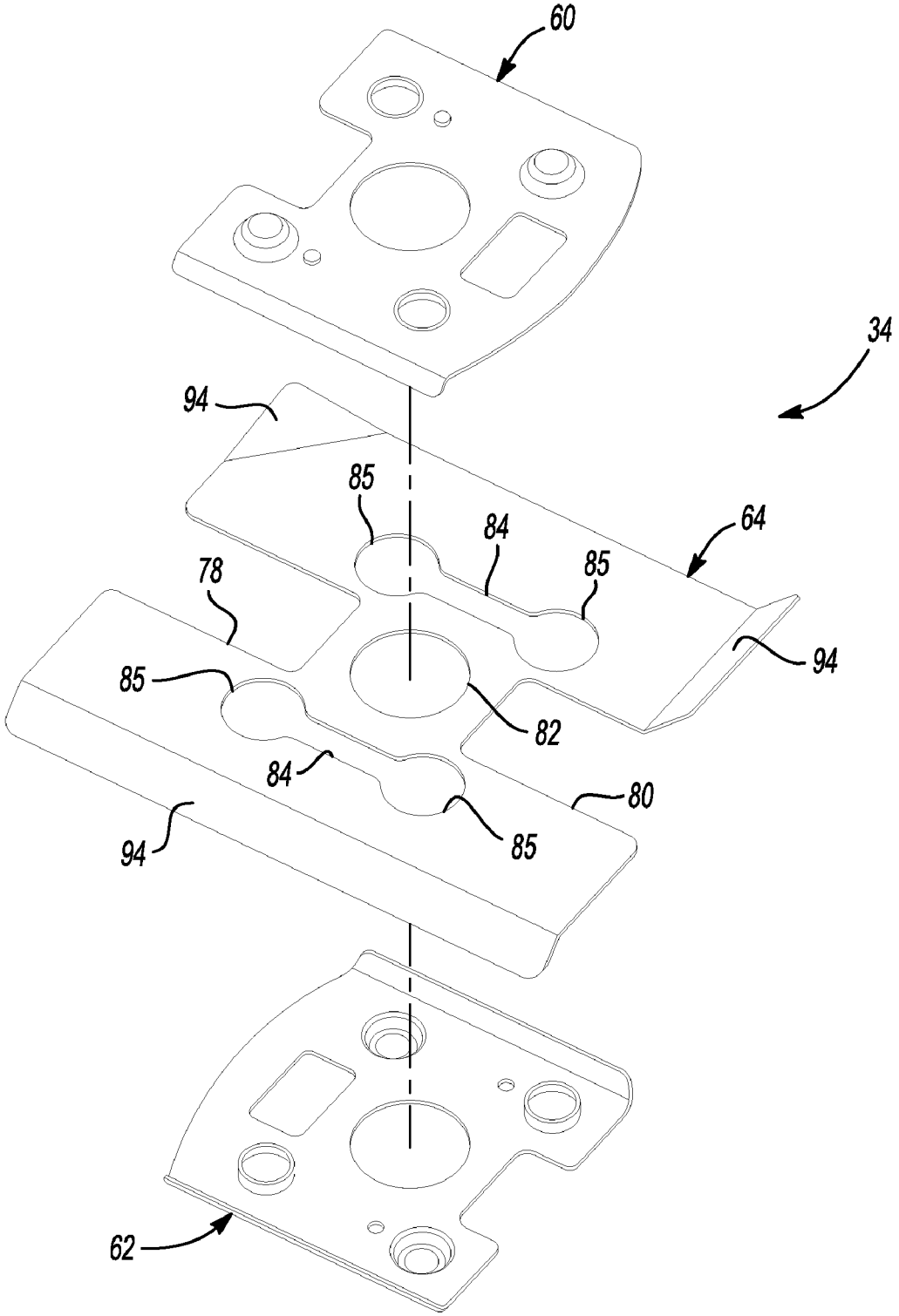
FIG. 11 is an exploded perspective view of still another embodiment of a fusible link according to the principles of the present disclosure.
Figure 12:
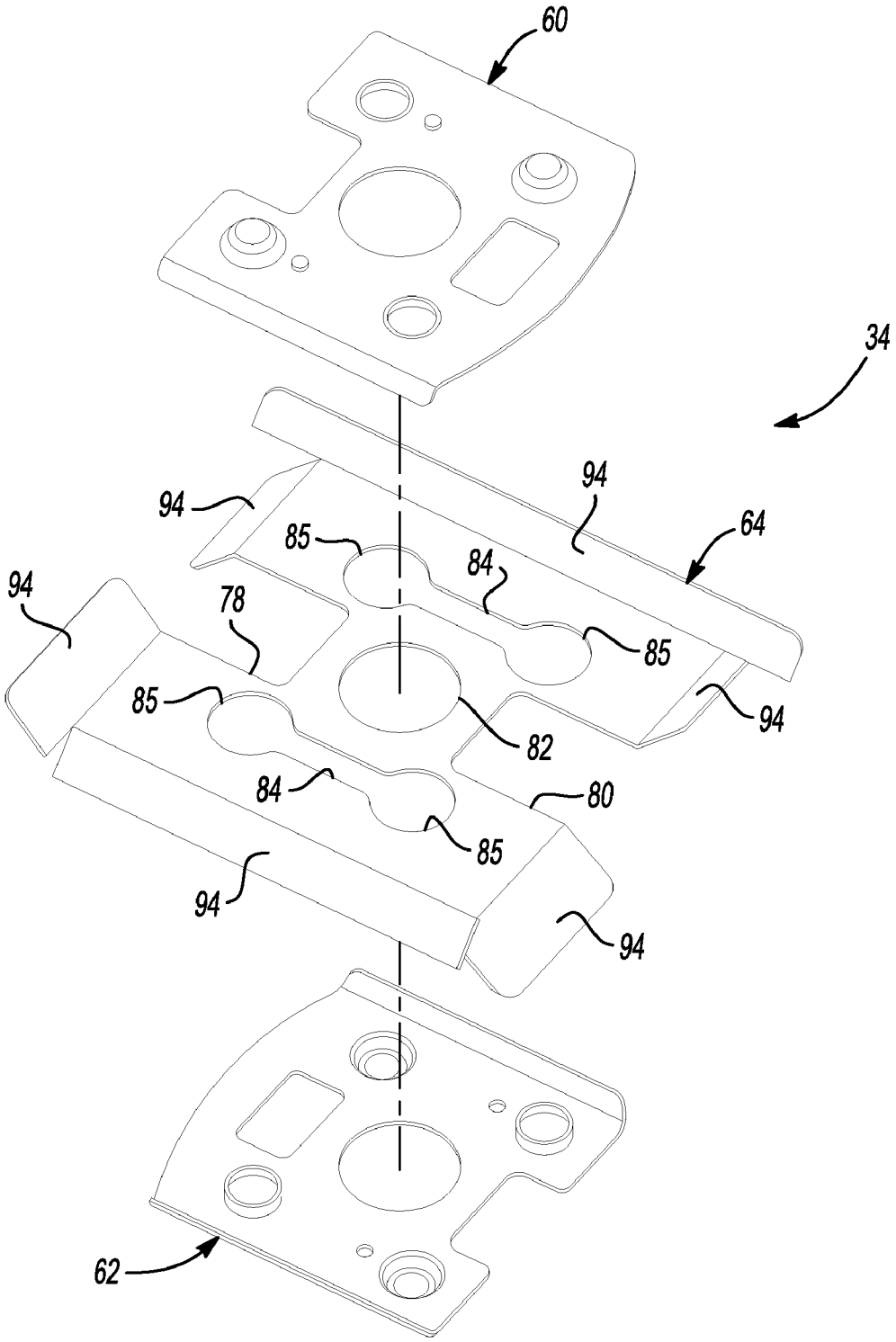
FIG. 12 is an exploded perspective view of still another embodiment of a fusible link according to the principles of the present disclosure.

The fusible link 34 may include a first plate 60, a second plate 62 and a conductor member 64. The first and second plates 60, 62 may be generally rectangular members having a length L1, a width W1 and a thickness T1. Each of the first and second plates 60, 62 may include a central aperture 66, one or more solder dimples 68, a plurality of protrusions 70, a plurality of indentations 72, a channel 74, and a pin aperture 76. The first and second plates 60, 62 may be formed from aluminum, steel, or copper, for example, or any other metallic material. It will be appreciated that the plates 60, 62 could be otherwise suitably shaped or formed. For example, as shown in FIG. 7, the first and second plates 60, 62 could be generally circular disks having channels 74 extending through more than half of the diameter of the disks.

In an engaged position (FIGS. 1, 4 and 6), a bottom surface of one of the plates 60, 62 may be in contact with a top surface of the other of the plates 60, 62. The first and second plates 60, 62 may be positioned relative to each other such that the center aperture 66 and the solder dimples 68 of the first plate 60 are in registration with the central aperture 66 and the solder dimples 68 of the second plate 62, respectively. The solder dimples 68 may provide a space or gap for the solder to flow when the first and second plates 60, 62 are soldered together. The protrusions 70 of the first plate 60 may be received within the indentations 72 of the second plate 62, and the protrusions 70 of the second plate 62 may be received within the indentations 72 of the first plate 60. The channels 74 of the first and second plates 60, 62 may extend in opposite directions. The channel 74 of the first plate 60 may be aligned with the pin aperture 76 of the second plate 62, and the channel 74 of the second plate 62 may be aligned with the pin aperture 76 of the first plate 60.

Figure 3:
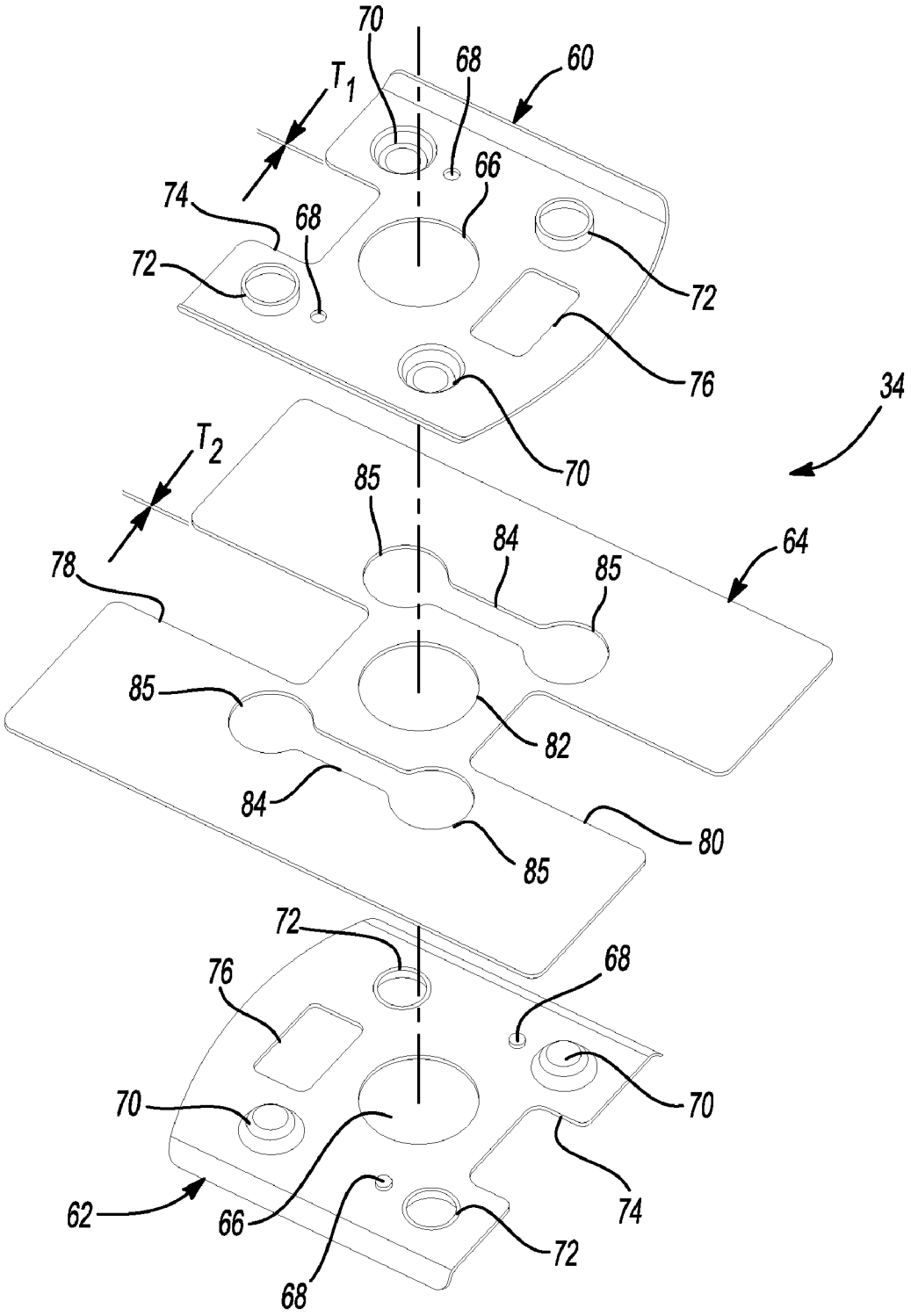
FIG. 3 is an exploded perspective view of a fusible link of a trigger assembly according to the principles of the present disclosure.
Figure 4:
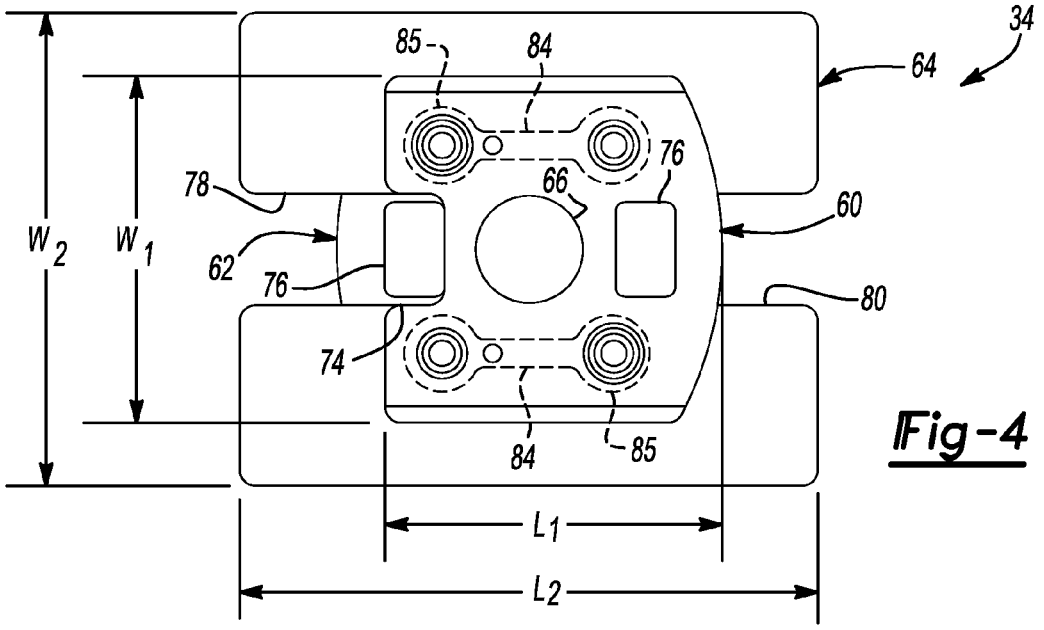
FIG. 4 is a top view of the fusible link of FIG. 3.
Figure 6:
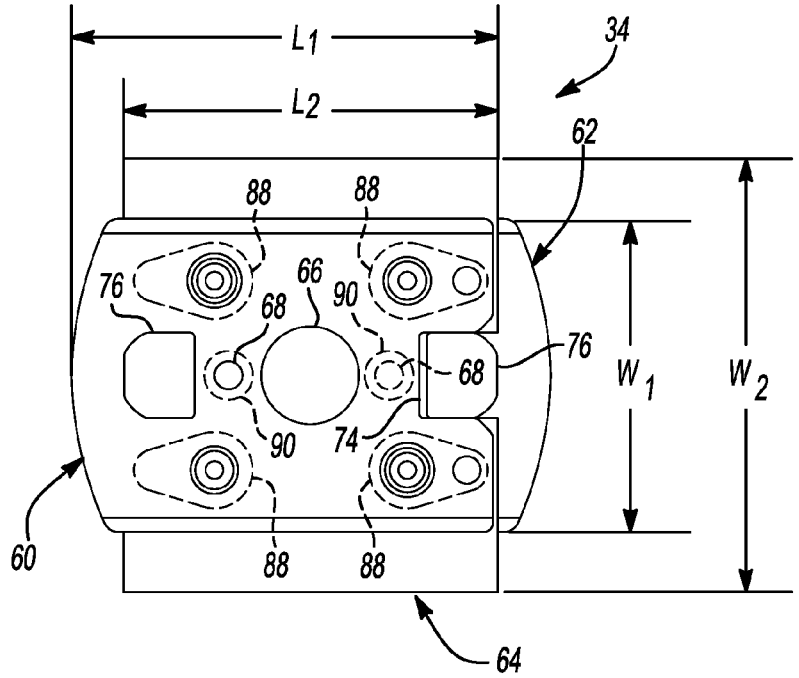
FIG. 6 is a top view of the fusible link of FIG. 5.

The conductor member 64 may be a thin, thermally conductive sheet or plate having a width W2, a length L2, and a thickness T2. The conductor member 64 may have a greater length and/or width than the length and width of the first and second plates 60, 62, i.e., L2>L1; and W2>W1 (FIGS. 3 and 4). The thickness T2 of the conductor member 64 may be less than the thickness T1 of the first and second plates 60, 62. The conductor member 64 may have a relatively high ratio of surface area to volume, thereby facilitating its ability to conduct heat. It will be appreciated that the length L2 of the conductor member 64 could be less than or equal to the length L1 of the first and second plates 60, 62, as shown in FIGS. 5 and 6, for example.

The conductor member 64 may be generally H-shaped (although other shapes can be used), and may have a first cutout or channel 78, a second cutout or channel 80, and a central aperture 82. The conductor member 64 may also include a plurality of slots 84 having apertures 85 disposed on each end of the slots 84 (FIG. 3). The slots 84 and apertures 85 may facilitate assembly and soldering of the fusible link 34. The slots 84 and/or apertures 85 may be generally aligned with the solder dimples 68 of the first and second plates 60, 62. Further, the apertures 85 may be in registration with the protrusions 70 and indentations 72 of the first and second plates 60, 62 to allow engagement between corresponding protrusions 70 and indentations 72.

Figure 5:
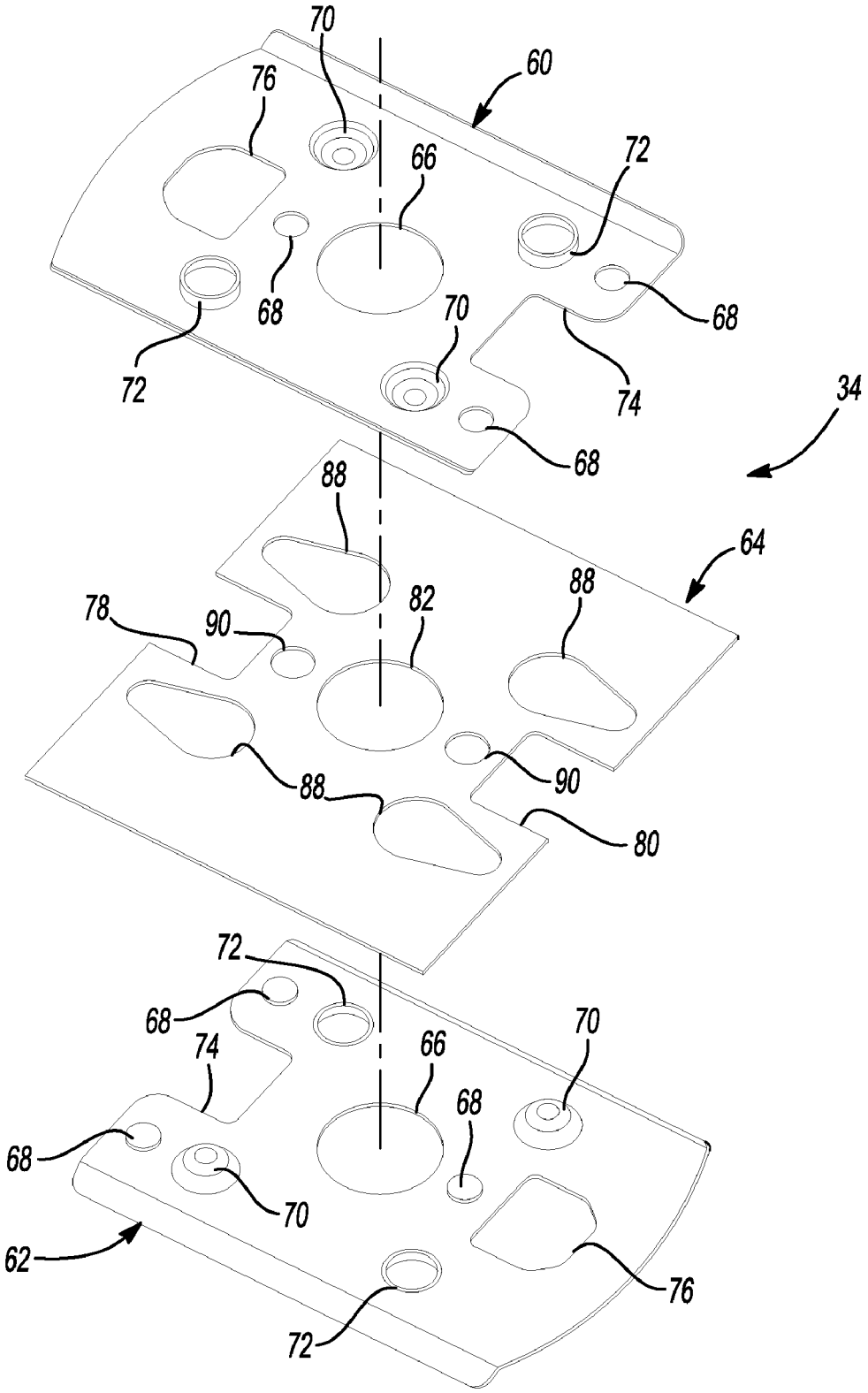
FIG. 5 is an exploded perspective view of another embodiment of a fusible link according to the principles of the present disclosure.

Additionally or alternatively, the conductor member 64 could include tapered, oblong apertures 88 and one or more apertures 90 (FIG. 5). The oblong apertures 88 and/or apertures 90 could be generally aligned with one or more of the solder dimples 68 of the first and second plates 60, 62. Further, the oblong apertures 88 may be in registration with the protrusions 70 and indentations 72 of the first and second plates 60, 62 to allow engagement between corresponding protrusions 70 and indentations 72 (FIGS. 5 and 6).

The conductor member 64 can be formed from any suitable thermally conductive material such as copper, aluminum, or gold, for example. The material forming the conductor member 64 may have a coefficient of thermal conductivity that is equal to or greater than the coefficient of thermal conductivity of the first and second plates 60, 62. It will be appreciated that the conductor member 64 and/or the first and second plates 60, 62 could be substantially formed from a first material and could be plated or coated with a second material to increase thermal conductivity.

In the engaged position (FIGS. 1, 4 and 6), the conductor member 64 may be disposed between the first and second plates 60, 62. The central aperture 82 may be in registration with the central apertures 66 of the first and second plates 60, 62. The first channel 78 of the conductor member 64 may be generally aligned or in registration with the channel 74 of the first plate 60. Similarly, the second channel 80 of the conductor member 64 may be generally aligned or in registration with the channel 74 of the second plate 62.

A heat fusible material, such as solder, for example, may be applied to the first and second plates 60, 62 and the conductor member 64 to secure the first and second plates 60, 62 together with the conductor member 64 therebetween (i.e., the engaged position). The heat fusible material can be applied to any suitable mating surfaces between the first and second plates 60, 62. Additionally or alternatively, the heat fusible material can be applied between the first plate 60 and conductor member 64 and between the second plate 62 and the conductor member 64. The heat fusible material could be applied to localized spots of the plates 60, 62 and/or conductor member 64. Alternatively, the first plate 60, second plate 62 and conductor member 64 could be clamped (or otherwise temporarily fixed) in the engaged position and submerged into the heat fusible material (in its liquid state), or the liquid heat fusible material could be poured over the first plate 60, second plate 62 and conductor member 64. Once the heat fusible material cools and solidifies, the first plate 60, second plate 62 and conductor member 64 may be secured in the engaged position. It will be appreciated that the heat fusible material could be applied to first plate 60, second plate 62 and conductor member 64 in any other suitable manner.

With the first plate 60, second plate 62 and the conductor member 64 secured in the engaged position, the first pin 30 may be received through the pin aperture 76 of one of the first and second plates 60, 62 such that the pin aperture 76 engages the first pin 30 at or near the intersection between the middle member 40 and the bottom member 42 of the first pin 30 (FIGS. 1 and 2). The second pin 32 may be received through the pin aperture 76 of the other of the first and second plates 60, 62 such that the slot 52 of the second pin 32 may engage the pin aperture 76 (FIGS. 1 and 2). As described above, the first end 48 of the second pin 32 may engage the slot 27 in the plug 25, while the second end 50 of the second pin 32 may engage the notch 44 in the first pin 30.

The adjustment member 36 may be threadably adjusted such that the conical tip 54 engages the dimple 46 in the first pin 30 and exerts a downward force (relative to the views shown in FIGS. 1 and 2). In the engaged position, the longitudinal axis of the conical tip 54 may be misaligned with the longitudinal axis of the second pin 32, such that the second end 50 of the second pin 32 acts as a fulcrum to the first pin 30. In this manner, the first pin 30 exerts a generally outward force on one of the pin apertures 76, and the second pin 32 exerts a generally outward force on the other of the pin apertures 76, thereby creating a shear force biasing the first and second plates 60, 62 away from each other. As described above, the heat fusible material (in a solid state) secures the first and second plates 60, 62 together, thereby overcoming the opposing shear forces of the first and second plates 60, 62

In response to a predetermined level of heat, the heat fusible material may begin to melt, weakening the engagement between the first and second plates 60, 62. When the heat fusible material has melted to a sufficient degree, the biasing forces applied to the first and second plates 60, 62 by the first and second pins 30, 32 may disengage the fusible link 34. The first and second plates 60, 62, conductor member 64, and first and second pins 30, 32 may then fall away from the sprinkler assembly 10, thereby removing the force biasing the plug 25 into engagement with the orifice 24. Pressure from the fire suppressant within the supply line 22 and the sprinkler body 12 may disengage the plug 25 and allow the fire suppressant to flow out of the orifice 24.

As described above, the conductor member 64 may be a relatively thin member formed from a material having a high coefficient of thermal conductivity. These geometric and material properties of the conductor member 64 may facilitate rapid heat conduction therethrough and decrease the amount of time required for the heat fusible material to melt and allow the fusible link 34 to disengage. The large surface area of the conductor member 64 (relative to its volume) facilitates collection of heat from a fire, via convection, and conduct the heat to the heat fusible material. Accordingly, the trigger assembly 18 having the conductor member 64 is able to respond to heat faster than prior art sprinklers, thereby increasing the ability of the sprinkler assembly 10 to successfully extinguish or control a fire.

Referring now to FIGS. 8-12, the conductor member 64 may include one or more flaps, forms or angled faces 94. The faces 94 may be formed by folding or bending one or more corners, sides and/or edges of the conductor member 64. The faces 94 may be folded or bent at one or more angles relative to each other and/or the first and second plates 60, 62. When the fusible link 34 is in an assembled (or engaged) condition, the faces 94 may extend beyond the peripheries of the first and second plates 60, 62. The faces 94 may facilitate absorption of radiant and/or convective heat that may be directed at the fusible link 34 from a plurality of directions, angles and/or locations. In this manner, the speed with which heat is transferred to the conductor member 64 (and consequently, the first and second plates 60, 62) may be increased, thereby increasing the response time of the trigger assembly 18.

The sizes, angles, shapes, locations and/or configurations of the faces 94 may be customized to accommodate a particular sprinkler assembly design and/or application and optimize the response time of the trigger assembly. Testing and/or computer aided engineering software, for example, may be utilized to customize the faces 94 for particular sprinkler assembly designs and/or applications.

Figure 13:
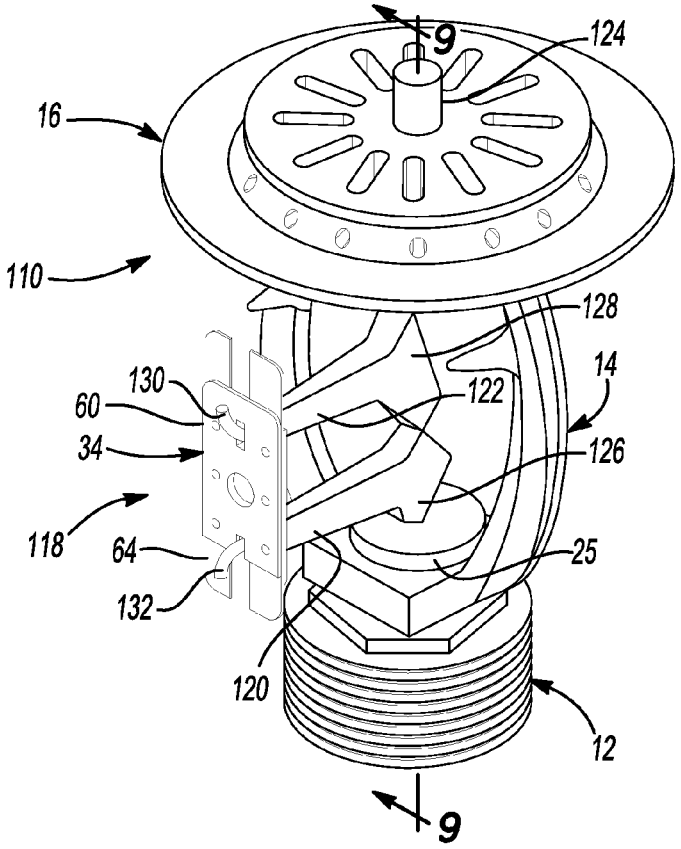
FIG. 13 is a perspective view of another embodiment of a sprinkler assembly according to the principles of the present disclosure.
Figure 14:
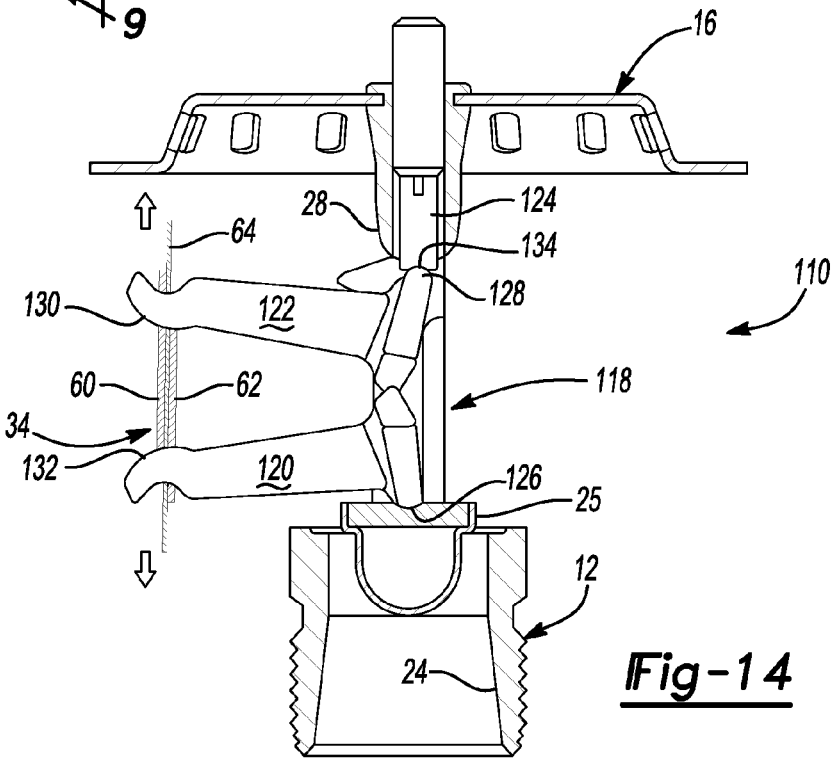
FIG. 14 is a cross-sectional view of the sprinkler assembly of FIG. 13.

With reference to FIGS. 13 and 14, another embodiment of the sprinkler assembly 10 is provided and is generally referred to as the sprinkler assembly 110. The sprinkler assembly 110 may include the sprinkler body 12, the frame 14, a deflector 16, and a trigger assembly 118.

The trigger assembly 118 may include a first lever 120, a second lever 122, a threaded adjustment member 124, and the fusible link 34. End 126 of the first lever 120 may engage a depression in the plug 25 sealing the orifice 24 of the sprinkler body 12. End 128 of the second lever 122 may be positioned in contact with the adjustment member 124. The first and second plates 60, 62 of the fusible link 34 may engage ends 130 and 132, of the first and second levers 120, 122, respectively.

To attach the trigger assembly 118 to the sprinkler assembly 110, the plug 25 may first be positioned to engage the orifice 24. Thereafter, the first and second levers 120, 122, having the fusible link 34 attached to ends 132 and 130, may be positioned such that end 126 of the first lever 120 is positioned within the depression of the plug 25. The adjustment member 124 may then be threadably adjusted within the apex 28 of the frame 14 until the end 128 of the second lever 122 is received within a tip 134 of the adjustment member 124. The adjustment member 124 may be further adjusted until a sufficient force is applied to the second lever 122 to hold the trigger assembly 118 securely in place and provide a fluid tight seal against the orifice 24. In this configuration, the end 132 of the second lever 122 may be biased upward (relative to the view shown in FIG. 14) and the end 130 of the first lever 120 may be biased downward (relative to the view shown in FIG. 14). Accordingly, when the fusible material securing the fusible link 34 in the engaged position reaches the predetermined temperature, the biasing forces of the first and second levers 120, 122 actuate the trigger assembly 118, and allow the plug 25 to disengage the orifice 24. As described above, the conductor member 64 disposed between the first and second plates 60, 62 conducts heat to the fusible material and quickens the response time of the fusible link 34.

Figure 15:
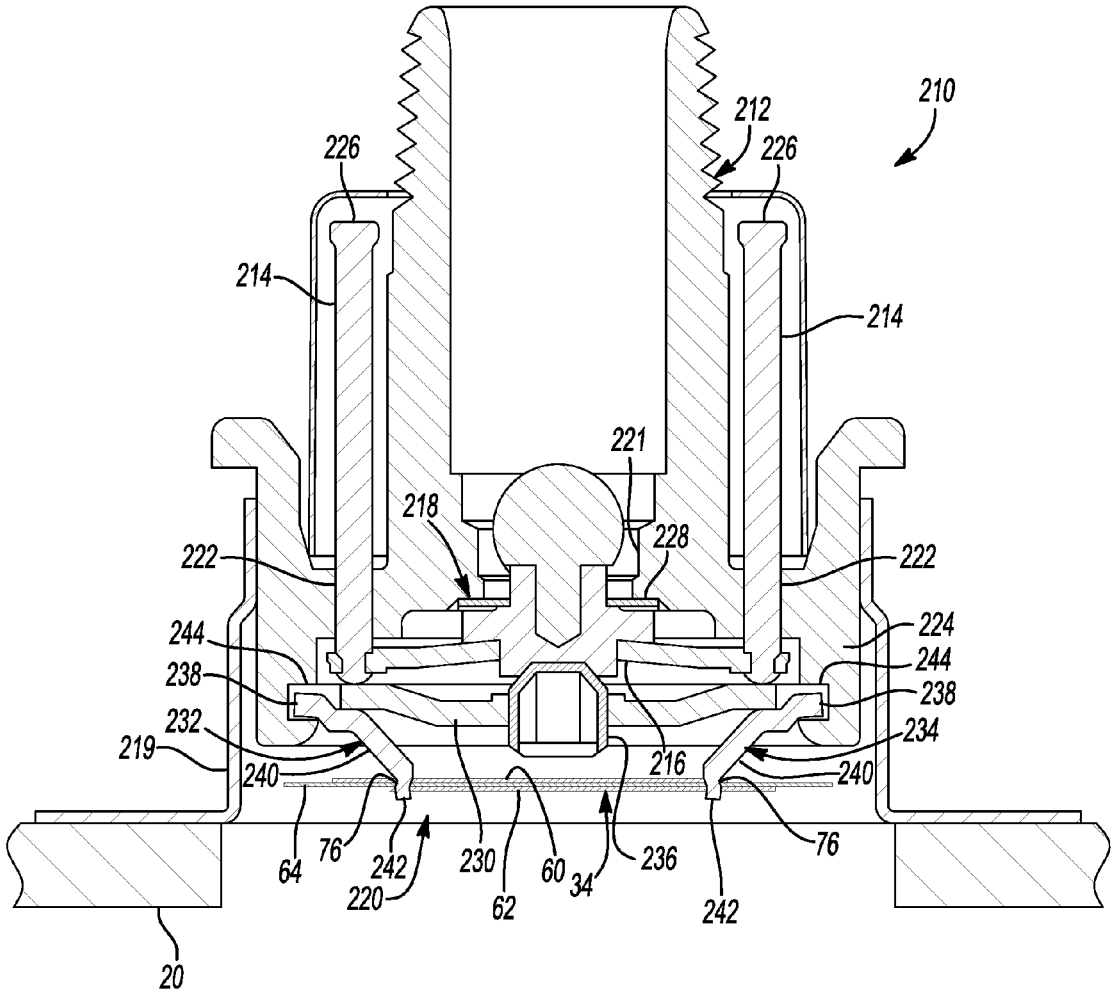
FIG. 15 is a cross-sectional view of yet another embodiment of a sprinkler assembly according to the principles of the present disclosure.
Figure 16:
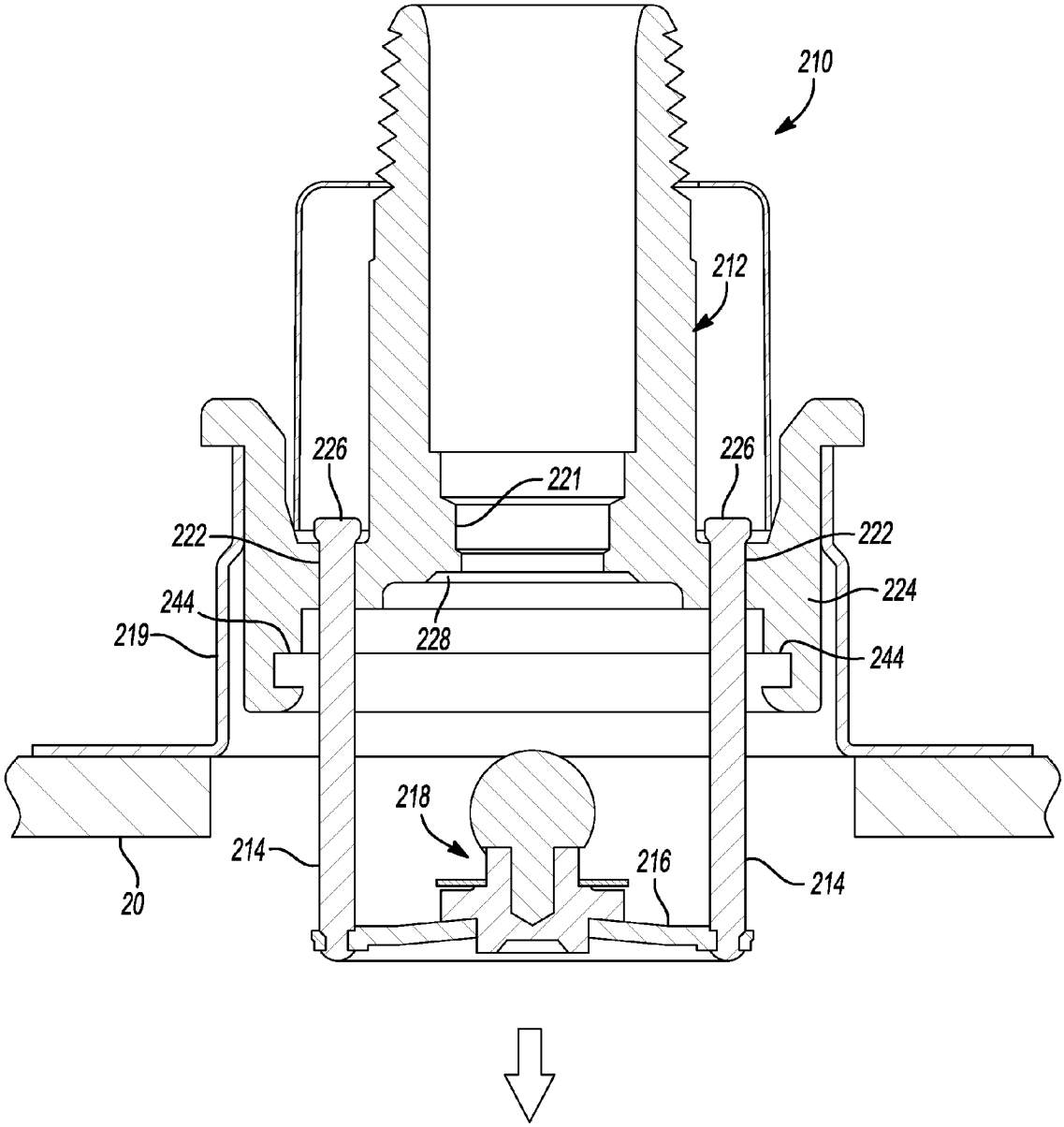
FIG. 16 is a cross-sectional view of the sprinkler assembly of FIG. 15 in a deployed position.

With reference to FIGS. 15 and 16, yet another embodiment of the sprinkler assembly 10 is provided and is generally referred to as the sprinkler assembly 210. The sprinkler assembly 210 may include a body 212, guide bolts 214, a deflector 216, a seal assembly 218, and a trigger assembly 220. A cup 219 may engage an outer diameter of the body 212 and the ceiling 20. The trigger assembly 220 is operable to releasably secure the deflector 216 in an engaged or concealed position (FIG. 15).

The body 212 may be generally tubular and may threadably engage the supply line 22 such that an orifice 221 in the body 212 may fluidly communicate with the supply line 22. The guide bolts 214 may extend though and slidably engage guide holes 222 formed in a rim 224 of the body 212. Ends 226 of the guide bolts 214 provide a stop for the guide bolts 214, and the deflector may be fixedly secured to an opposite end of the guide bolts 214. The seal assembly 218 may be disposed on a central portion of the deflector 216 and, when compressed against a seat 228 of the orifice 221, may form a fluid-tight seal, preventing fluid from flowing therethrough.

The trigger assembly 220 may include an adjustment plate 230, a first pin 232, a second pin 234, and the fusible link 34. The adjustment plate 230 may be positioned below the deflector 216 and the seal assembly 218. An adjustment screw 236 may be threaded through a central bore in the adjustment plate 230 and may press upwardly against a recess in the seal assembly 218, thereby biasing the seal assembly 218 into sealing engagement with the orifice 221 (FIG. 15).

The first and second pins 232, 234 may include first ends 238, middle portions 240 and second ends 242. In an engaged position (FIG. 15), the first ends 238 may engage a groove 244 in the sprinkler body 212, and the second ends 242 may engage pin apertures 76 of the first and second plates 60, 62. The middle portions 240 may support the adjustment plate 230 in an upward position, biasing the adjustment screw 236 against the deflector 216. In this configuration, the second ends 242 of the first and second pins 232, 234 are biased outward. The fusible material securing the first plate 60, the conductor member 64 and the second plate 62 in the engaged position enables the fusible link 34 to secure the trigger assembly 220 in the engaged position.

When the fusible material reaches the predetermined temperature, it will begin to melt, allowing the outward bias of the first and second pins 232, 234 to disengage the first and second plates 60, 62. As described above, the conductor member 64 may collect heat from a fire, for example, and conduct the heat to the fusible material and the first and second plates 60, 62, thereby quickening the response time of the trigger assembly 220. When the fusible link 34 disengages, the plates 60, 62, the pins 232, 234, and the adjustment plate 230 may fall downward due to gravity and away from the deflector 216. This allows the guide bolts 214 to slide downward within the guide holes 222 into a deployed position (FIG. 16), thereby disengaging the seal assembly 218 from the orifice 221. In the deployed position, the fire suppressant may flow from the supply line 22, through the orifice 221 and deflect off of the deflector 216.

In addition to the characteristics described above, the conductor member 64 may be elastically and/or plastically deformable such that it may deform upon striking the inside of the cup 219 or ceiling 20 when the fusible link 34 disengages. This may reduce the probability of the conductor member 64 binding within the cup 219 or ceiling 20 upon deployment of the sprinkler assembly 210.

Figure 17:
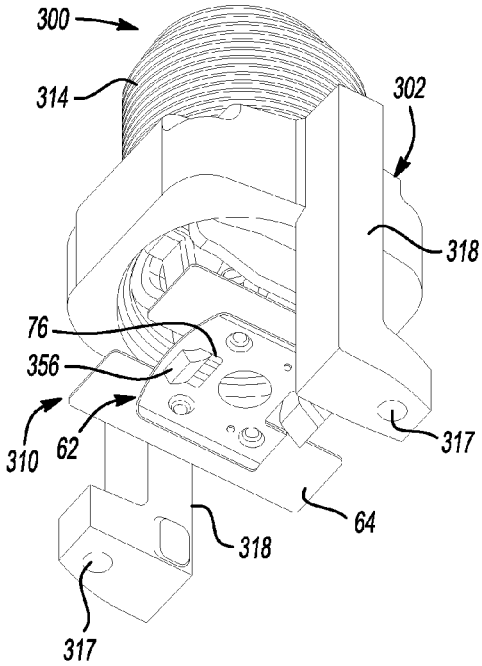
FIG. 17 is a partial perspective view of a still another embodiment of a sprinkler assembly according to the principles of the present disclosure.
Figure 18:
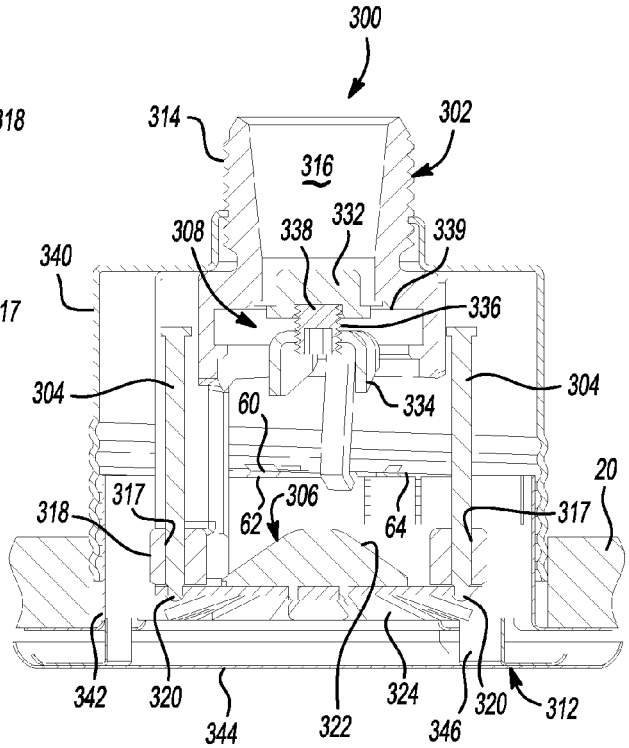
FIG. 18 is a first cross-sectional view of the sprinkler assembly of FIG. 17.
Figure 19:
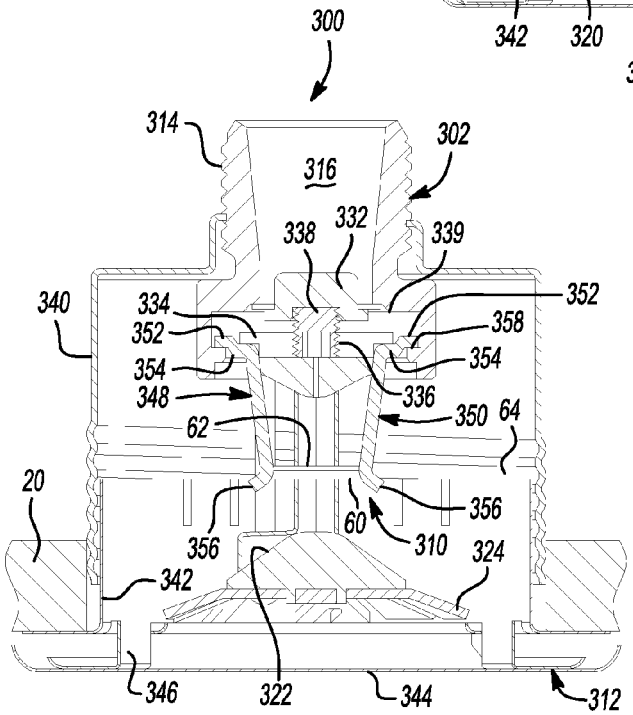
FIG. 19 is a second cross-sectional view of the sprinkler assembly of FIGS. 17 and 18.

With reference to FIGS. 17-19, still another embodiment of the sprinkler assembly 10 is provided and is generally referred to as the sprinkler assembly 300. The sprinkler assembly 300 may include a body 302, guide bolts 304, a deflector 306, a seal assembly 308, a trigger assembly 310, and a cover assembly 312. The sprinkler assembly 300 may be a concealed sprinkler assembly such that it may remain concealed above the ceiling 20 in an engaged position and the deflector 306 may extend below the ceiling 20 in a deployed position.

The body 302 may include a threaded portion 314, an orifice 316 and legs 318. The threaded portion 314 engages the supply line 22 (FIG. 1) such that the orifice 316 may fluidly communicate with the supply line 22. The guide bolts 304 may extend though and slidably engage guide holes 317 formed in the legs 318. Ends 320 of the guide bolts 304 may be fixedly secured to the deflector 306. The deflector 306 may include a convex body portion 322 having a plurality of tines 324 that may extend downward and radially outward therefrom.

The seal assembly 308 may include a plug 332, an adjustment member 334 and an adjustment screw 336. In an engaged position, the trigger assembly 310 may retain the adjustment member 334 relative to the orifice 316. The adjustment screw 336 may threadably engage the adjustment member 334 and may be threadably adjusted upward (relative to the views shown in FIGS. 18 and 19) against the plug 332. An end 338 of the adjustment screw 336 may urge the plug 332 against a seat 339 of the orifice 316, thereby sealing the orifice 316 and preventing fluid from flowing therethrough.

The cover assembly 312 may include a cup 340, a base 342 and a cover plate 344. The cup 340 may engage the threaded portion 314 of the body 302 and may substantially surround the legs 318. The base 342 may be a generally tubular member engaging an inner diameter of the cup 340 and extending downward through the opening in the ceiling 20. The base 342 may include a plurality of generally L-shaped legs 346 extending below the ceiling 20 and engaging the cover plate 344. The cover plate 344 may be soldered to the legs 346 and may cover the opening in the ceiling 20 and conceal the sprinkler assembly 300, thereby improving the aesthetics of the room in which the sprinkler assembly is installed.

The trigger assembly 310 may include a first pin 348, a second pin 350, and the fusible link 34. The first and second pins 348, 350 may include first portions 352, second portions 354 and third portions 356. In the engaged position, the first portions 352 may engage a groove or lip 358 in the sprinkler body 302, and the third portions 356 may engage pin apertures 76 of the first and second plates 60, 62. The second portions 354 may support the adjustment member 334 in an upward position, biasing the adjustment screw 336 against the plug 332. In this configuration, the third portions 356 of the first and second pins 348, 350 are biased outward. The fusible material securing the first plate 60, the conductor member 64 and the second plate 62 in the engaged position enables the fusible link 34 to secure the trigger assembly 310 in the engaged position.

In response to a predetermined level of heat, the solder retaining the cover plate 344 to the legs 346 may melt and allow the cover plate 344 to fall due to gravity away from the sprinkler assembly 300 and ceiling 20. With the cover plate 344 removed, the guide bolts 304 may be free to slide through the guide holes 317 formed in the legs 318 of the body 302, thereby placing the deflector 306 at a predetermined distance from the orifice 316.

When the fusible material reaches the predetermined temperature, it will begin to melt, allowing the outward bias of the first and second pins 348, 350 to disengage the first and second plates 60, 62. As described above, the conductor member 64 may collect heat from a fire, for example, and conduct the heat to the fusible material and the first and second plates 60, 62, thereby quickening the response time of the trigger assembly 310. When the fusible link 34 disengages, the plates 60, 62, the pins 348, 350, and the adjustment member 334 may fall downward due to gravity and away from the orifice 316, allowing the fire suppressant to flow through the orifice 316 and deflect off of the deflector 306. The fire suppressant deflects off of the convex body portion 322 and tines 324 of the deflector 306, and is projected into the room below in a predetermined spray pattern.

Further description of the structure and function of exemplary sprinkler assemblies are provided in U.S. Pat. Nos. 7,290,618, 6,962,208 and 6,152,236, and U.S. Patent Application Publication No. 2007/0187116, the disclosures of which are hereby incorporated by reference, as if fully set forth herein. It will be appreciated that the sprinkler assemblies 10, 110, 210 and trigger assemblies 18, 118, 220 could be otherwise suitably formed, and the fusible link 34 could be integrated into any suitable sprinkler assembly.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A heat responsive trigger assembly for a sprinkler comprising:

a first plate having a bottom face;

a second plate including a top face engaging said bottom face;

a thermally conductive member disposed between said top and bottom faces and extending beyond a perimeter of at least one of said first and second plates, wherein said thermally conductive member includes at least one aperture; and a heat fusible material securing said first and second plates in an engaged position, wherein at least one of said first and second plates includes a protruding solder dimple in registration with said aperture of said thermally conductive member, said aperture being larger in size than said solder dimple of said at least one of said first and second plates so that a space is disposed between said solder dimple and said aperture, wherein said first and second plates are allowed to disengage in response to said heat fusible material reaching a predetermined temperature, thereby allowing a fire suppressant to discharge from the sprinkler.

2. The heat responsive trigger assembly for a sprinkler according to claim 1, wherein said thermally conductive member collects heat from a heat source and conducts said heat to said heat fusible material.

3. The heat responsive trigger assembly for a sprinkler according to claim 1, wherein said thermally conductive member has a higher coefficient of thermal conductivity than said first and second plates.

4. The heat responsive trigger assembly for a sprinkler according to claim 1, wherein said thermally conductive member has a higher ratio of surface area to volume than said first and second plates.

5. The heat responsive trigger assembly for a sprinkler according to claim 1, wherein said thermally conductive member includes a cutout in registration with a channel of one of said first and second plates.

6. The heat responsive trigger assembly for a sprinkler according to claim 1, wherein said thermally conductive member is generally H-shaped.

7. A heat responsive trigger assembly for a sprinkler comprising:

a first plate having a bottom face;

a second plate including a top face engaging said bottom face;

a thermally conductive member disposed between said top and bottom faces and extending beyond a perimeter of at least one of said first and second plates; and a heat fusible material securing said first and second plates in an engaged position, wherein said first and second plates are allowed to disengage in response to said heat fusible material reaching a predetermined temperature, thereby allowing a fire suppressant to discharge from the sprinkler, wherein said first plate includes a first planar surface having a protrusion extending from and surrounded entirely by said first planar surface and said second plate includes a second planar surface having a corresponding indentation extending from and surrounded entirely by said second planar surface and sized and shaped to receive said protrusion.

8. The heat responsive trigger assembly for a sprinkler according to claim 7, wherein said thermally conductive member includes a hole receiving said protrusion extending therethrough.

9. The heat responsive trigger assembly for a sprinkler according to claim 1, wherein a width of said thermally conductive member is greater than widths of said first and second plates.

10. The heat responsive trigger assembly for a sprinkler according to claim 1, wherein a length of said thermally conductive member is greater than lengths of said first and second plates.

11. The heat responsive trigger assembly for a sprinkler according to claim 1, wherein a thickness of said thermally conductive member is less than thicknesses of said first and second plates.

12. The heat responsive trigger assembly for a sprinkler according to claim 1, wherein said first plate includes a first channel and said second plate includes a second channel, and said first and second channels extend in opposite directions.

13. The heat responsive trigger assembly for a sprinkler according to claim 1, wherein said first plate includes a first aperture engaging a first pin, and said second plate includes a second aperture engaging a second pin.

14. A heat responsive trigger assembly for a sprinkler comprising:

a first plate having a bottom face;

a second plate including a top face engaging said bottom face;

a thermally conductive member disposed between said top and bottom faces and extending beyond a perimeter of at least one of said first and second plates; and a heat fusible material securing said first and second plates in an engaged position, wherein said first and second plates are allowed to disengage in response to said heat fusible material reaching a predetermined temperature, thereby allowing a fire suppressant to discharge from the sprinkler, wherein said thermally conductive member includes a planar portion and at least one face formed by a bend in said thermally conductive member such that said at least one face is angled non-orthogonally relative to said planar portion and extending laterally beyond said first and second plates.

15. A sprinkler assembly comprising:

a sprinkler body adapted to engage a supply line, said sprinkler body including an orifice providing a passageway therethrough;

a frame extending from said sprinkler body and including a deflector disposed thereon adapted to alter a trajectory of a fire suppressant;

a plug adapted to seal said orifice in an engaged position; and a trigger assembly adapted to releasably secure said plug in an engaged position, said trigger assembly including a first lever engaging a first plate, a second lever engaging a second plate, and a conductor member disposed between said first and second plates, wherein said conductor member includes an aperture, wherein a heat fusible material releasably secures a top surface of said first plate to a bottom surface of said second plate and said conductor member therebetween, whereby at least a portion of said conductor member extends beyond perimeters of said first and second plates thereby facilitating heat conduction to said heat fusible material, wherein at least one of said first and second plates includes a protruding solder dimple in registration with said aperture of said conductor member, said aperture being larger in size than said solder dimple of said at least one of said first and second plates so that a space is disposed between said solder dimple and said aperture.

16. The sprinkler assembly according to claim 15, wherein said first and second plates are allowed to disengage in response to said heat fusible material reaching a predetermined temperature.

17. The sprinkler assembly according to claim 16, wherein disengagement of said first and second plates allows said fire suppressant to discharge from the sprinkler.

18. The sprinkler assembly according to claim 15, wherein said conductor member collects heat from a heat source and conducts said heat to said heat fusible material.

19. The sprinkler assembly according to claim 15, wherein said conductor member has a higher coefficient of thermal conductivity than said first and second plates.

20. The sprinkler assembly according to claim 15, wherein said conductor member has a higher ratio of surface area to volume than said first and second plates.

21. The sprinkler assembly according to claim 15, wherein said conductor member includes a first cutout aligned with a first channel of said first plate and a second cutout aligned with a second channel of said second plate.

22. The sprinkler assembly according to claim 15, wherein said conductor member is generally H-shaped.

23. A sprinkler assembly comprising:

a sprinkler body adapted to engage a supply line, said sprinkler body including an orifice providing a passageway therethrough;

a frame extending from said sprinkler body and including a deflector disposed thereon adapted to alter a trajectory of a fire suppressant;

a plug adapted to seal said orifice in an engaged position; and a trigger assembly adapted to releasably secure said plug in an engaged position, said trigger assembly including a first lever engaging a first plate, a second lever engaging a second plate, and a conductor member disposed between said first and second plates, wherein a heat fusible material releasably secures a top surface of said first plate to a bottom surface of said second plate and said conductor member therebetween, whereby at least a portion of said conductor member extends beyond perimeters of said first and second plates thereby facilitating heat conduction to said heat fusible material, wherein said first plate includes a first planar surface having a protrusion extending from and surrounded entirely by said first planar surface and said second plate includes a second planar surface having a corresponding indentation extending from and surrounded entirely by said second planar surface and sized and shaped to receive said protrusion.

24. The sprinkler assembly according to claim 23, wherein said conductor member includes a hole receiving said protrusion extending therethrough.

25. The sprinkler assembly according to claim 15, wherein a width of said conductor member is greater than widths of said first and second plates.

26. The sprinkler assembly according to claim 15, wherein a length of said conductor member is greater than lengths of said first and second plates.

27. A sprinkler assembly comprising:

a sprinkler body adapted to engage a supply line, said sprinkler body including an orifice providing a passageway therethrough;

a frame extending from said sprinkler body and including a deflector disposed thereon adapted to alter a trajectory of a fire suppressant;

a plug adapted to seal said orifice in an engaged position; and a trigger assembly adapted to releasably secure said plug in an engaged position, said trigger assembly including a first lever engaging a first aperture in a first plate, a second lever engaging a second aperture in a second plate, and a conductor member disposed between said first and second plates, wherein a heat fusible material releasably secures a top surface of said first plate to a bottom surface of said second plate and said conductor member therebetween, whereby at least a portion of said conductor member extends beyond perimeters of said first and second plates thereby facilitating heat conduction to said heat fusible material, wherein a thickness of said conductor member is less than thicknesses of said first and second plates and said conductor member is free from any compression forces being applied to an edge thereof in a longitudinal direction extending from said first aperture to said second aperture and parallel to a plane of said first and second plates.

28. A sprinkler assembly comprising:

a sprinkler body adapted to engage a supply line, said sprinkler body including an orifice providing a passageway therethrough;

a frame extending from said sprinkler body and including a deflector disposed thereon adapted to alter a trajectory of a fire suppressant;

a plug adapted to seal said orifice in an engaged position; and a trigger assembly adapted to releasably secure said plug in an engaged position, said trigger assembly including a first lever engaging a first plate, a second lever engaging a second plate, and a conductor member disposed between said first and second plates, wherein a heat fusible material releasably secures a top surface of said first plate to a bottom surface of said second plate and said conductor member therebetween, whereby at least a portion of said conductor member extends beyond perimeters of said first and second plates thereby facilitating heat conduction to said heat fusible material, wherein said conductor member includes a planar portion and at least one face formed by a bend in said thermally conductive member such that said at least one face is angled non-orthogonally relative to said planar portion and extending laterally beyond said first and second plates.

29. A sprinkler assembly comprising:

a sprinkler body adapted to engage a supply line, said sprinkler body including an orifice providing a passageway therethrough;

a frame extending from said sprinkler body and including a deflector disposed thereon adapted to alter a trajectory of a fire suppressant;

a plug adapted to seal said orifice in an engaged position; and a trigger assembly adapted to releasably secure said plug in said engaged position, said trigger assembly including a first plate having a top surface, a second plate having bottom surface contacting said top surface of said first plate, a conductor member disposed between said first and second plates wherein said conductor member includes an aperture and at least one of said first and second plates includes a protruding solder dimple in registration with said aperture of said conductor member, said aperture being larger in size than said solder dimple of said at least one of said first and second plates so that a space is disposed between said solder dimple and said aperture, a first pin engaging at least one of said first and second plates and engaging said plug at a first end, and a second pin having a first portion and a second portion, said first portion engaging a second end of said first pin, said second portion engaging at least one of said first and second plates, wherein a heat fusible material releasably secures said first plate to said second plate, and said conductor member is adapted to facilitate conduction of heat to said heat fusible material.

30. The sprinkler assembly according to claim 29, wherein said first and second plates are allowed to disengage in response to said heat fusible material reaching a predetermined temperature.

31. The sprinkler assembly according to claim 30, wherein disengagement of said first and second plates allows said fire suppressant to discharge from the sprinkler.

32. The sprinkler assembly according to claim 29, wherein said conductor member collects heat from a heat source and conducts said heat to said heat fusible material.

33. The sprinkler assembly according to claim 29, wherein said conductor member has a higher coefficient of thermal conductivity than said first and second plates.

34. The sprinkler assembly according to claim 29, wherein said conductor member has a higher ratio of surface area to volume than said first and second plates.

35. The sprinkler assembly according to claim 29, wherein said conductor member includes a first cutout aligned with a first channel of said first plate and a second cutout aligned with a second channel of said second plate.

36. The sprinkler assembly according to claim 29, wherein said conductor member is generally H-shaped.

37. A sprinkler assembly comprising:

a sprinkler body adapted to engage a supply line, said sprinkler body including an orifice providing a passageway therethrough;

a frame extending from said sprinkler body and including a deflector disposed thereon adapted to alter a trajectory of a fire suppressant;

a plug adapted to seal said orifice in an engaged position; and a trigger assembly adapted to releasably secure said plug in said engaged position, said trigger assembly including a first plate having a top surface, a second plate having bottom surface contacting said top surface of said first plate, a conductor member disposed between said first and second plates, a first pin engaging at least one of said first and second plates and engaging said plug at a first end, and a second pin having a first portion and a second portion, said first portion engaging a second end of said first pin, said second portion engaging at least one of said first and second plates, wherein a heat fusible material releasably secures said first plate to said second plate, and said conductor member is adapted to facilitate conduction of heat to said heat fusible material, wherein said first plate includes a first planar surface having a protrusion extending from and surrounded entirely by said first planar surface and said second plate includes a second planar surface having a corresponding indentation extending from and surrounded entirely by said second planar surface and sized and shaped to receive said protrusion.

38. The sprinkler assembly according to claim 37, wherein said conductor member includes a hole receiving said protrusion therethrough.

39. The sprinkler assembly according to claim 29, wherein a width of said conductor member is greater than widths of said first and second plates.

40. The sprinkler assembly according to claim 29, wherein a length of said conductor member is greater than lengths of said first and second plates.

41. A sprinkler assembly comprising:

a sprinkler body adapted to engage a supply line, said sprinkler body including an orifice providing a passageway therethrough;

a frame extending from said sprinkler body and including a deflector disposed thereon adapted to alter a trajectory of a fire suppressant;

a plug adapted to seal said orifice in an engaged position; and a trigger assembly adapted to releasably secure said plug in said engaged position, said trigger assembly including a first plate having a top surface, a second plate having bottom surface contacting said top surface of said first plate, a conductor member disposed between said first and second plates, a first pin engaging a first aperture in at least one of said first and second plates and engaging said plug at a first end, and a second pin having a first portion and a second portion, said first portion engaging a second end of said first pin, said second portion engaging a second aperture in at least one of said first and second plates, wherein a heat fusible material releasably secures said first plate to said second plate, and said conductor member is adapted to facilitate conduction of heat to said heat fusible material, wherein a thickness of said conductor member is less than thicknesses of said first and second plates and said conductor member is free from any compression forces being applied to an edge thereof in a longitudinal direction extending from said first aperture to said second aperture and parallel to a plane of said first and second plates.

42. The sprinkler assembly according to claim 29, wherein said conductor member includes one or more angled faces.

43. A sprinkler assembly comprising:

a sprinkler body adapted to engage a supply line, said sprinkler body including an orifice providing a passageway therethrough;

a seal member adapted to seal said orifice;

a deflector disposed on a plurality of elongated guide bolts slidably engaging said sprinkler body and movable between a concealed position and a deployed position; and a trigger assembly adapted to releasably secure said seal member in said orifice, said trigger assembly including:

a first plate having a first aperture and a top surface;

a second plate having a second aperture and a bottom surface contacting said top surface of said first plate;

a conductor member disposed between said top and bottom surfaces, wherein said conductor member includes an aperture and at least one of said first and second plates includes a protruding solder dimple in registration with said aperture of said conductor member, said aperture being larger in size than said solder dimple of said at least one of said first and second plates so that a space is disposed between said solder dimple and said aperture;

a first pin engaging said first aperture and said sprinkler body; and a second pin engaging said second aperture and said sprinkler body, wherein a heat fusible material releasably secures said first plate to said second plate, and said conductor member is adapted to facilitate conduction of heat to said heat fusible material.

44. The sprinkler assembly of claim 43, wherein said first and second plates are allowed to disengage in response to said heat fusible material reaching a predetermined temperature.

45. The sprinkler assembly according to claim 44, wherein disengagement of said first and second plates allows a fire suppressant to discharge from the sprinkler.

46. The sprinkler assembly according to claim 43, wherein said conductor member collects heat from a heat source and conducts said heat to said heat fusible material.

47. The sprinkler assembly according to claim 43, wherein said conductor member has a higher coefficient of thermal conductivity than said first and second plates.

48. The sprinkler assembly according to claim 43, wherein said conductor member has a higher ratio of surface area to volume than said first and second plates.

49. The sprinkler assembly according to claim 43, wherein said conductor member includes a first cutout aligned with a first channel of said first plate and a second cutout aligned with a second channel of said second plate.

50. The sprinkler assembly according to claim 43, wherein said conductor member is generally H-shaped.

51. A sprinkler assembly comprising:

a sprinkler body adapted to engage a supply line, said sprinkler body including an orifice providing a passageway therethrough;

a seal member adapted to seal said orifice;

a deflector disposed on a plurality of elongated guide bolts slidably engaging said sprinkler body and movable between a concealed position and a deployed position; and a trigger assembly adapted to releasably secure said seal member in said orifice, said trigger assembly including:

a first plate having a first aperture and a top surface;

a second plate having a second aperture and a bottom surface contacting said top surface of said first plate;

a conductor member disposed between said top and bottom surfaces;

a first pin engaging said first aperture and said sprinkler body; and a second pin engaging said second aperture and said sprinkler body, wherein a heat fusible material releasably secures said first plate to said second plate, and said conductor member is adapted to facilitate conduction of heat to said heat fusible material, wherein said first plate includes a first planar surface having a protrusion extending from and surrounded entirely by said first planar surface and said second plate includes a second planar surface having a corresponding indentation extending from and surrounded entirely by said second planar surface and sized and shaped to receive said protrusion.

52. The sprinkler assembly according to claim 51, wherein said conductor member includes a hole receiving said protrusion extending therethrough.

53. The sprinkler assembly according to claim 43, wherein a width of said conductor member is greater than widths of said first and second plates.

54. The sprinkler assembly according to claim 43, wherein a length of said conductor member is greater than lengths of said first and second plates.

55. A sprinkler assembly comprising:

a sprinkler body adapted to engage a supply line, said sprinkler body including an orifice providing a passageway therethrough;

a seal member adapted to seal said orifice;

a deflector disposed on a plurality of elongated guide bolts slidably engaging said sprinkler body and movable between a concealed position and a deployed position; and a trigger assembly adapted to releasably secure said seal member in said orifice, said trigger assembly including:

a first plate having a first aperture and a top surface;

a second plate having a second aperture and a bottom surface contacting said top surface of said first plate;

a conductor member disposed between said top and bottom surfaces;

a first pin engaging said first aperture and said sprinkler body; and a second pin engaging said second aperture and said sprinkler body, wherein a heat fusible material releasably secures said first plate to said second plate, and said conductor member is adapted to facilitate conduction of heat to said heat fusible material, wherein a thickness of said conductor member is less than thicknesses of said first and second plates and said conductor member is free from any compression forces being applied to an edge thereof in a longitudinal direction extending from said first aperture to said second aperture and parallel to a plane of said first and second plates.

56. The sprinkler assembly according to claim 43, wherein said deflector includes a convex body portion and a plurality of downward and radially outward extending tines extending from said convex body portion.

57. The sprinkler assembly according to claim 43, wherein said conductor member includes one or more angled faces.

* * * * *